US007806728B2

(12) United States Patent
Sogo et al.

(10) Patent No.: US 7,806,728 B2
(45) Date of Patent: Oct. 5, 2010

(54) ELECTRICAL CONNECTOR WITH CRIMP CONTACT

(75) Inventors: Taizo Sogo, Tokyo (JP); Takayuki Arai, Tokyo (JP); Takeshi Sato, Tokyo (JP); Taku Kawano, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 14 days.

(21) Appl. No.: 12/436,934

(22) Filed: May 7, 2009

(65) Prior Publication Data

US 2009/0280700 A1 Nov. 12, 2009

(30) Foreign Application Priority Data

May 8, 2008 (JP) ..... 2008-122130

(51) Int. Cl.
*H01R 13/432* (2006.01)

(52) U.S. Cl. ..... 439/596; 439/382; 439/749

(58) Field of Classification Search ..... 439/596, 439/382, 746–749, 872, 877
See application file for complete search history.

(56) References Cited

U.S. PATENT DOCUMENTS 3,753,193 A * 8/1973 Teagno et al. ..... 439/854
3,764,960 A * 10/1973 Heimbrock ..... 439/749
6,702,623 B2 * 3/2004 Fukuda et al. ..... 439/701
7,402,087 B2 * 7/2008 Wang ..... 439/752.5

FOREIGN PATENT DOCUMENTS

JP 2006-221819 8/2006

* cited by examiner

*Primary Examiner*—Neil Abrams
(74) *Attorney, Agent, or Firm*—Wenderoth, Lind & Ponack, LLP.

(57) ABSTRACT

An electrical connector is offered which has a crimp contact connected with a connector cable, the crimp contact being held in position to a connector housing without rattling. The crimp contact has sidewall surfaces of U-shaped cross section. The sidewall surfaces are located on opposite sides. The sidewall surfaces have outwardly facing engagement protrusions. The connector housing has a connector body and a disengagement-preventing cover for closing a top portion of the connector body to prevent the crimp contact from coming off upward after the crimp contact has been mounted in the connector body. The connector body has engagement portions in which the protrusions of the crimp contact are inserted and received perpendicularly to the longitudinal direction of the connector cable. The protrusions are engaged in the engagement portions. The disengagement-preventing cover is mounted to the connector body via a hinge such that the cover can be opened and closed.

1 Claim, 3 Drawing Sheets

ELECTRICAL CONNECTOR WITH CRIMP CONTACT

BACKGROUND OF THE INVENTION

1. Field of the Invention

The present invention relates to an electrical connector including a crimp contact and a connector housing in which the crimp contact is inserted and held.

2. Prior Art

In the prior art, in order that a connector cable be crimped and connected to a crimp contact and that the crimp contact be inserted into a connector housing, a cable 22 is mounted to the crimp contact 21, crimped and electrically connected to the crimp contact in a crimping portion 23, and fixed, for example, as shown in FIG. 3. Then, the crimp contact 21 is inserted from an opening at one end of the connector housing 24 made of a synthetic resin.

Thereafter, the crimp contact is made to pass over a protrusion 25 and is engaged. The protrusion 25 is formed on a resilient molded lance 24*a* of the connector housing 24. The protrusion 25 is located in an intermediate position of the longitudinal extent of the crimp contact 21 and projects in a direction perpendicular to the longitudinal direction of the crimp contact. The crimp contact 21 is locked against backward motion. In this way, the molded lance is formed in the direction of insertion of the crimp contact 21, thus forming a means for preventing the crimp contact from disengaging.

Another known structure is shown in FIG. 4, where a crimp contact 26 has a flexible contact lance 26*a*. If the crimp contact 26 is inserted into a connector housing 27 from the opening at one end of the housing 27 after a cable 22 has been connected and held to the crimp contact 26, the front end of the contact lance 26*a* falls when it passes over a step portion 27*a* and becomes caught on the step portion 27*a* which is formed in an intermediate position of the longitudinal extent of the housing 27 inside the housing 27. In this way, the crimp contact is prevented from moving in the direction opposite to the direction of insertion and thus does not disengage. Such conventional electrical connectors have structures as shown in FIGS. 5A and 5B, where the connectors are known to have contact lances 28*a* and 29*a*, respectively. Furthermore, a connector described in JPA-2006221819 is known.

In such conventional electrical connectors, however, a spear-like or wedge-like protrusion, known as a lance, is formed in the direction of insertion of the crimp contact 21 or crimp contact 26 and, therefore, disconnection is prevented. A slight gap is left between the front-end surface of the lance and the end surface of the engagement portion. This produces rattling in the direction of insertion. If the crimp contact is used repeatedly, the engagement between the lance and the engagement portion becomes less tight gradually. There arises a problem that if the crimp contact is strongly pulled in the direction reverse to the direction of insertion, the crimp contact comes off.

SUMMARY OF THE INVENTION

The present invention is intended to solve the foregoing problems with the prior art. It is an object of the invention to provide an electrical connector having a crimp contact which is prevented from being pulled out longitudinally of a connector cable and which, when mounted in a connector housing, is prevented from rattling longitudinally of the crimp contact.

Accordingly, the present invention provides an electrical connector including a crimp contact electrically connected with a connector cable and a connector housing for placing the crimp contact in position and holding the crimp contact. The crimp contact has sidewall surfaces of U-shaped cross section on opposite sides. The sidewall surfaces have engagement protrusions extending outwardly. The connector housing has a connector body and a disengagement-preventing cover. The protrusions of the crimp contact are inserted into the connector body perpendicularly to the longitudinal direction of the connector cable and accommodated in the connector body. The connector body has engagement portions in which the protrusions are engaged. The disengagement-preventing cover is mounted to the connector body via a hinge such that the cover can be opened and closed. The disengagement-preventing cover closes a top portion of the connector body to prevent the crimp contact from coming off upward after mounted in the connector body.

In the electrical connector of the present invention, the crimp contact is inserted and fitted into the fitting portion of the connector housing in a direction perpendicular to the direction in which the crimp contact is pulled out by the connector cable. Consequently, there is no possibility that the crimp contact is pulled out in the longitudinal direction of the connector cable. The crimp contact mounted in the connector housing is prevented from rattling in position in the longitudinal direction. Consequently, the contact of the contacting portions of the crimp contact is stabilized.

DETAILED DESCRIPTION OF THE PREFERRED EMBODIMENTS

Figure 1:
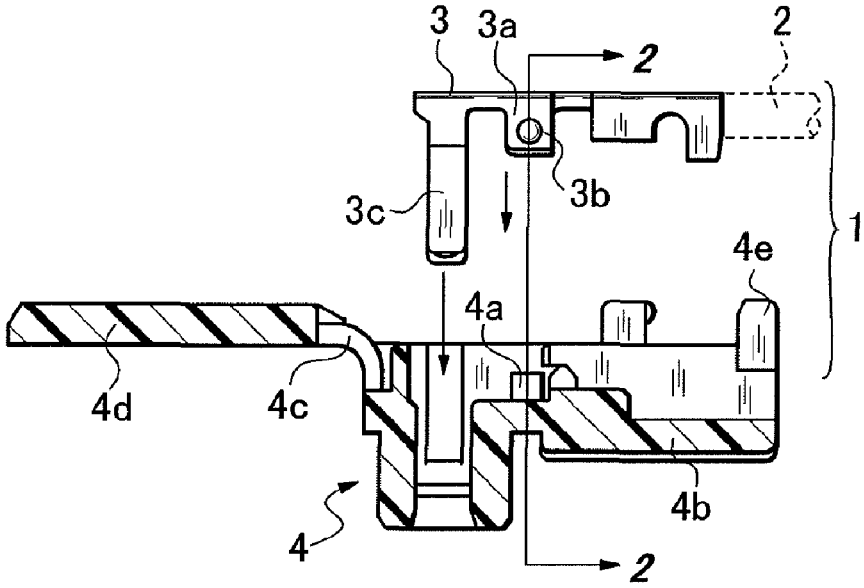
FIG. 1 is a vertical cross section of an electrical connector according to an embodiment of the present invention.
Figure 2:
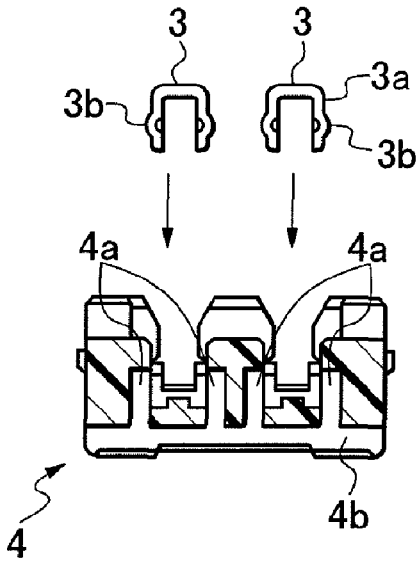
FIG. 2 is a cross-sectional view taken on line 2-2 of FIG. 1.
Figure 3:
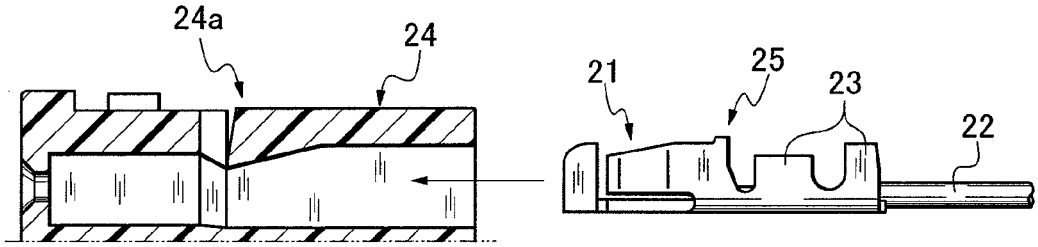
Fig. 3 PRIOR ART
FIG. 3 is a vertical cross section of an electrical connector according to a prior-art example, showing the manner in which a crimp contact is fitted in a connector housing having a molded lance.
Figure 4:
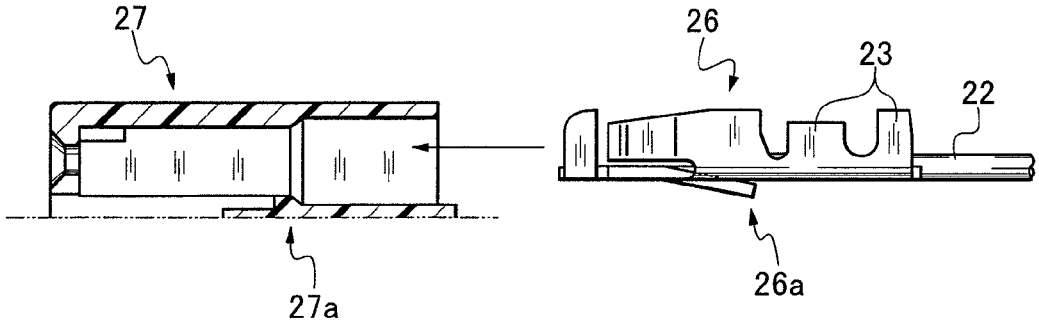
Fig. 4 PRIOR ART
FIG. 4 is a vertical cross section of an electrical connector according to another prior-art example, showing the manner in which a crimp contact having a contact lance is fitted in a connector housing.
Figure 5A:
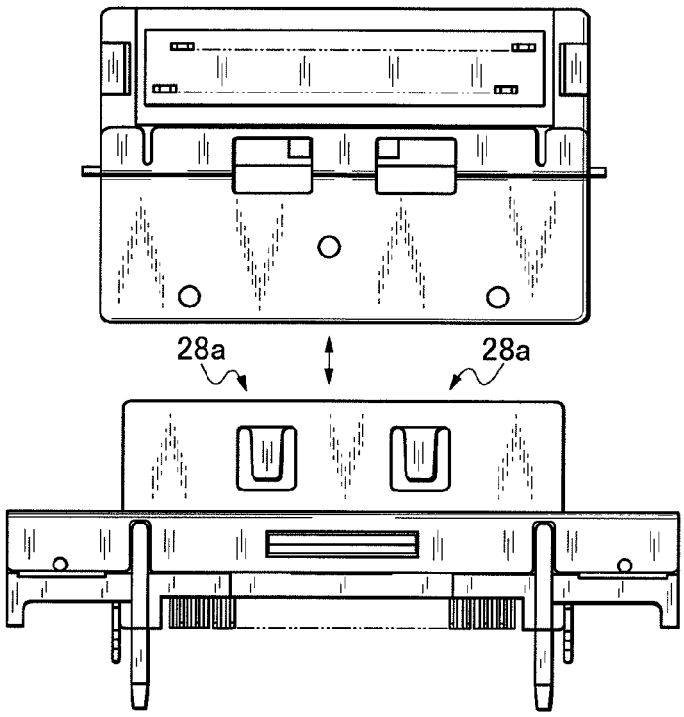
Fig. 5A PRIOR ART
FIGS. 5A and 5B are a front elevation and a vertical cross section in side elevation, respectively of an electrical connector according to a further prior-art example.
Figure 5B:
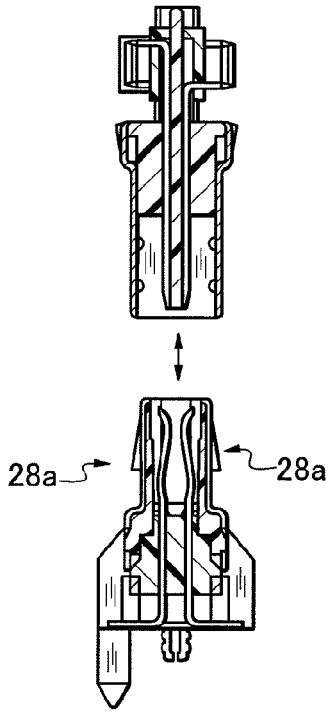
Fig. 5B PRIOR ART
Figure 6A:
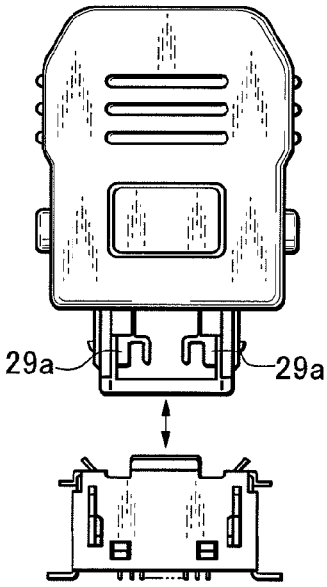
Fig. 6A PRIOR ART
FIGS. 6A and 6B are a front elevation and a vertical cross section in side elevation, respectively, of an electrical connector according to a further prior-art example.
Figure 6B:
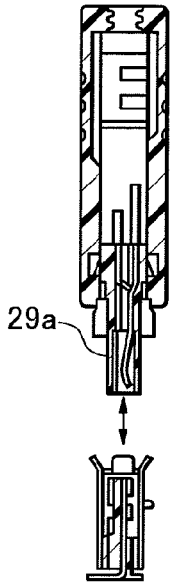
Fig. 6B PRIOR ART

Referring to FIGS. 1 and 2, an electrical connector 1 according to the present invention includes a crimp contact 3 and a connector housing 4 made of a synthetic resin. The crimp contact 3 is electrically connected with a connector cable 2. The housing 4 places the crimp contact 3 in position and holds the contact 3.

As shown in FIG. 2, in the electrical connector 1, semi-spherical engagement protrusions 3*b* project outward from sidewall surfaces 3*a* of U-shaped cross section of the crimp contact 3. The connector housing 4 includes a connector body 4*b* and a disengagement-preventing cover 4*d* being a cover member that can be opened and closed via a hinge 4*c*. The connector body 4*b* has groove-shaped accommodation portions in which the crimp contact 3 with which the connector cable 2 is connected is received. Concave engagement portions 4*a* in which the protrusions 3*b* are engaged are formed in both sidewalls of each accommodation portion.

The distance between the both sidewall surfaces of the crimp contact 3 (i.e., the dimension of the outer width) is set to be slightly smaller than the dimension of the inner width of the accommodation portions in the connector body 4*b*. The distance between the protrusions 3*b* (the dimension of the outer width) is set to be larger than the dimension of the inner width of the accommodation portions. When the crimp contact 3 connected with the connector cable 2 is inserted into the accommodation portions inside the connector body 4*b* from above, the protrusions 3*b* of the crimp contact 3 come into engagement with the upper fringes of the engagement portions 4*a* and 4*b*, respectively. As a result, the protrusions 3*b* are anchored.

After the crimp contact 3 is accommodated and anchored in the connector body 4*b* as described previously, the disengagement-preventing cover 4*d* is rotated about the hinge 4*c* to close the opening in the top portion of the connector body 4*b*. The closed cover 4*d* is engaged and anchored to a locking portion 4*e* standing upright from the rear end of the connector body 4*b* and becomes locked. The crimp contact 3 is engaged and anchored by the engagement portions 4*a*. In addition, upward escaping motion is doubly prevented by closing the disengagement-preventing cover 4*d* in this way.

When the crimp contact 3 has been mounted, the protrusions 3*b* engage the engagement portions 4*a*. The disengagement-preventing cover 4*d* suppresses upward motion to thereby prevent the connected cable 2 from coming off if it is pulled in the longitudinal direction. The protrusions 3*b* are reliably engaged and anchored by the resilient force of the sidewall surfaces 3*a* that tend to spread apart outwardly.

In this way, in the electrical connector 1, the crimp contact 3 with which the connector cable 2 is connected is placed in position and held both in the direction in which the cable 2 is pulled and in the perpendicular direction. Therefore, when the connector has been mounted, it rattles neither in the longitudinal direction nor in the perpendicular direction. The contact position of the contact portion 3*c* of the crimp contact 3 is stabilized.

What is claimed is:

1. An electrical connector having a crimp contact electrically connected with a connector cable and a connector housing for placing the crimp contact in position and holding the crimp contact;

wherein said crimp contact has sidewall surfaces of U-shaped cross section, the sidewall surfaces being located on opposite sides, the sidewall surfaces having outwardly facing engagement protrusions;

wherein said connector housing has a connector body and a disengagement-preventing cover for closing a top portion of the connector body to prevent the crimp contact from coming off upward after the crimp contact has been mounted in the connector body the cover being mounted to the connector body via a hinge so as to be capable of being opened and closed; and wherein the connector body has engagement portions into which the engagement protrusions of the crimp contact are inserted and received in a direction perpendicular to a longitudinal direction of the connector cable, the protrusions being engaged in the engagement portions.

* * * * *